United States Patent [19]

Farley et al.

[11] 3,964,544

[45] June 22, 1976

[54] PRESSURE OPERATED ISOLATION VALVE FOR USE IN A WELL TESTING AND TREATING APPARATUS, AND ITS METHOD OF OPERATION

[75] Inventors: David L. Farley; Burchus Q. Barrington, both of Duncan, Okla.

[73] Assignee: Halliburton Company, Duncan, Okla.

[22] Filed: June 20, 1975

[21] Appl. No.: 588,990

[52] U.S. Cl. ..... 166/315; 166/224 A; 166/264

[51] Int. Cl.[2] ..... E21B 43/00; E21B 49/00

[58] Field of Search ..... 166/264, 250, 224 R, 166/224 A, 152, 53, .5, 184, 185, 142, 315; 73/151

[56] References Cited

UNITED STATES PATENTS

| | | | |
|---|---|---|---|
| 2,951,536 | 9/1960 | Garrett | 166/224 A X |
| 3,410,346 | 11/1968 | Garrett et al. | 166/53 |
| 3,459,264 | 8/1969 | Olson et al. | 166/250 |
| 3,500,911 | 3/1970 | Farley et al. | 166/250 |
| 3,664,415 | 5/1972 | Wray et al. | 166/.5 |
| 3,696,868 | 10/1972 | Taylor, Jr. | 166/224 A |
| 3,717,203 | 2/1973 | Kirkpatrick et al. | 166/224 A |
| 3,827,494 | 8/1974 | Crowe | 166/224 A |
| 3,856,085 | 12/1974 | Holden et al. | 166/264 |
| 3,858,649 | 1/1975 | Wray et al. | 166/264 X |

*Primary Examiner*—Stephen J. Novosad
*Attorney, Agent, or Firm*—John H. Tregoning; Floyd A. Gonzalez

[57] ABSTRACT

In a well testing tool having a spring whose biasing force is supplemented by the hydrostatic pressure in the well annulus at the testing depth, a method and apparatus for isolating the spring from the pressure in the well annulus utilizing the pressure differential between the well annulus and the testing tool bore which exists after the formation is isolated and for maintaining the isolation of the spring force during subsequent interior bore pressure increases such as during formation treating operations. An isolation valve is provided whose closing force is generated by isolating the testing tool bore from the well annulus, and then increasing the well annulus pressure above the hydrostatic pressure. The pressure differential thus created is utilized to close the valve. Uni-directional acting means is provided in the isolation valve responsive to the interior bore pressure such that when the interior bore pressure is increased subsequent to the closing of the isolation valve, the uni-directional acting means will not cuase the isolating valve to reopen, but will nullify the effect of the subsequent pressure increase such that the valve will remain closed. The opening force is provided by compressing a spring when the valve is closed, thus allowing the isolation valve to reopen when the pressure in the annulus is returned to hydrostatic. An isolation valve is provided which is normally open, which closes only after the well annulus pressure exceeds a reference presssure trapped in the bore of the testing tool by a predetermined amount, and which remains closed during subsequent pressure increases in the bore of the testing tool.

12 Claims, 5 Drawing Figures

Figure 3:
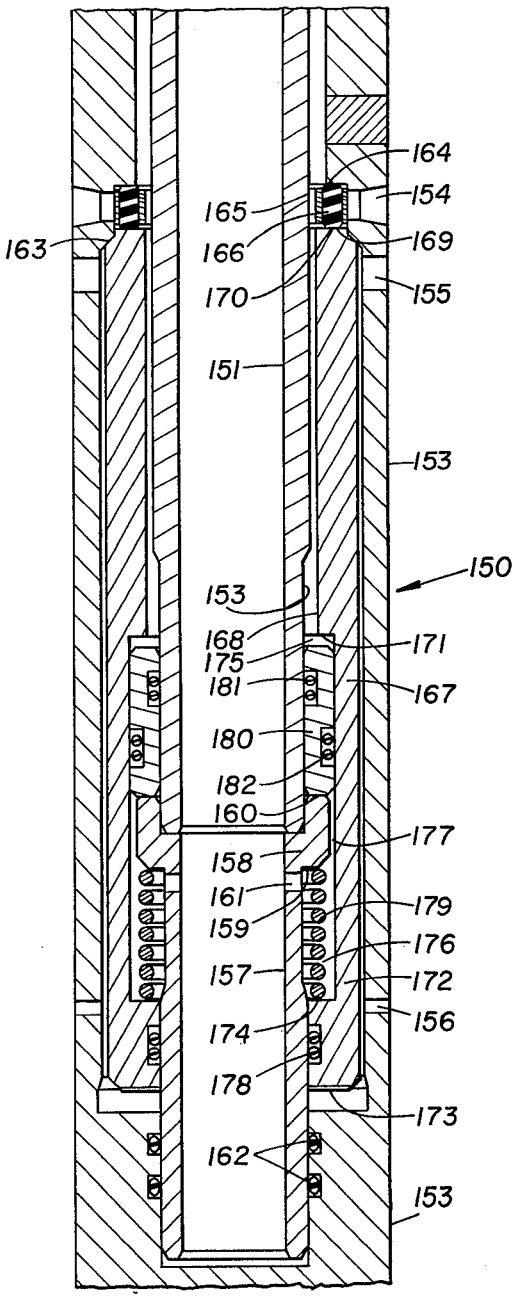

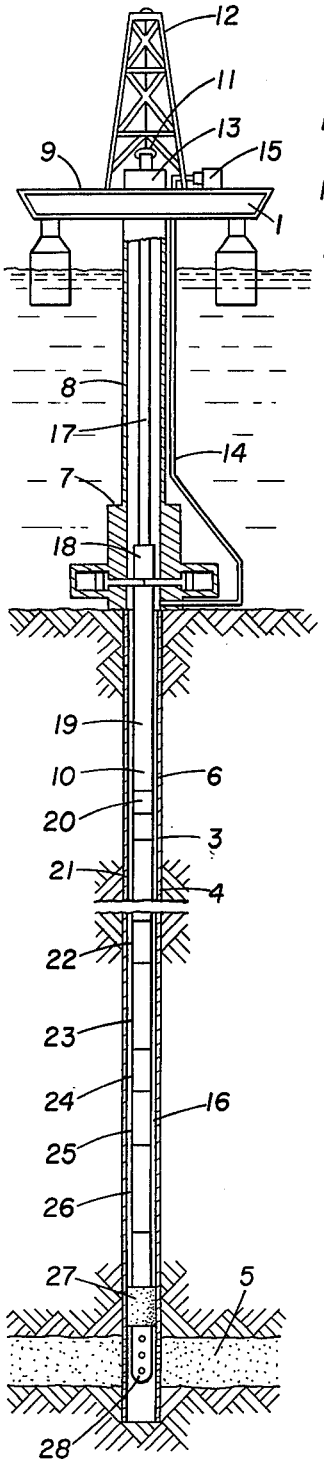
FIG. 1
FIG. 2a
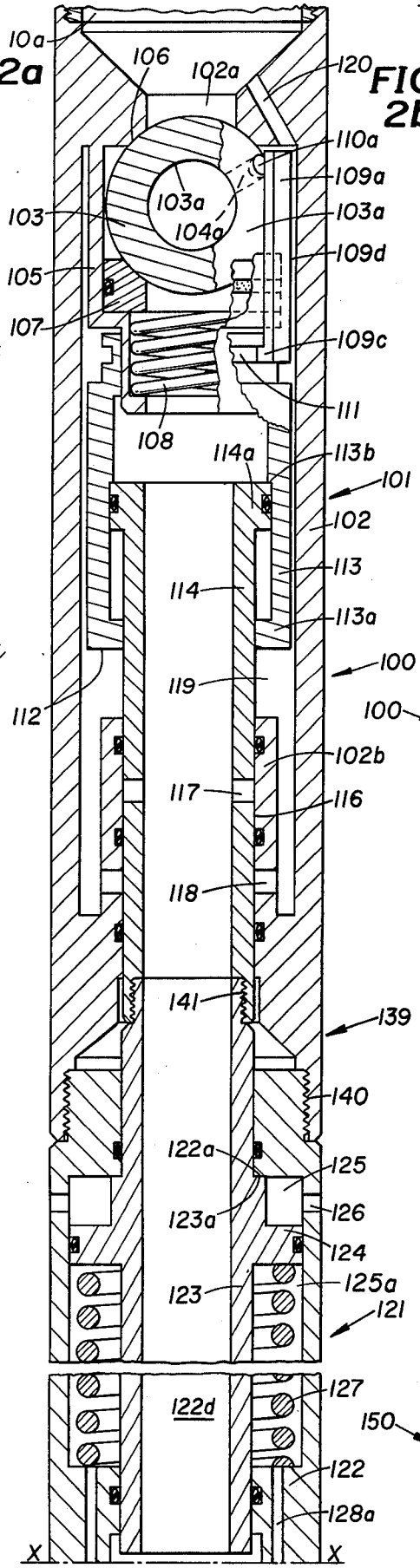
FIG. 2b
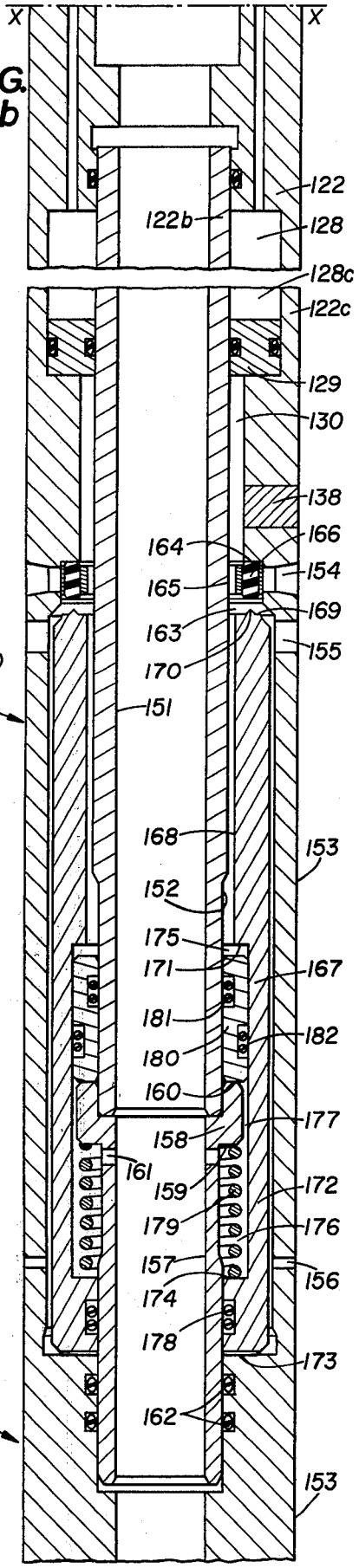

PRESSURE OPERATED ISOLATION VALVE FOR USE IN A WELL TESTING AND TREATING APPARATUS, AND ITS METHOD OF OPERATION

BACKGROUND AND SUMMARY OF THE INVENTION

The invention herein disclosed pertains to a method and apparatus for treating a formation which contains petroleum for use in conjunction with the testing of the formation. The invention is particularly useful in the testing and treating of offshore wells where it is desirable to conduct a testing or treating program, or both, with a minimum of tool string manipulation; and preferably with the blowout preventers closed during a major portion of the program.

It is known in the art that sampler valves and tester valves for testing the productivity of oil wells may be operated by applying pressure increases to the fluid in the annulus of the well. For instance, U.S. Pat. No. 3,664,415 to Wray et al. discloses a sampler valve which is operated by applying annulus pressure increases against a piston in opposition to a predetermined charge of inert gas. When the annulus pressure overcomes the gas pressure, the piston moves to open a sampler valve thereby allowing formation fluid to flow into a sample chamber contained within the tool, and into the testing string facilitating production measurements and testing.

U.S. Pat. No. 3,858,649 to Holden et al. also discloses a sampler apparatus which is opened and closed by applying pressure changes to the fluid in the well annulus. This apparatus contains supplementing means wherein the inert gas pressure is supplemented by the hydrostatic pressure of the fluid in the well annulus as the testing string is lowered into the borehole. This feature allows the use of lower inert gas pressure at the surface and provides that the gas pressure will automatically be adjusted in accordance with the hydrostatic pressure and environment at the testing depth, thereby avoiding complicated gas pressure calculations required by the earlier devices for proper operation. U.S. Pat. No. 3,856,085 to Holden et al. likewise provides a supplementing means for the inert gas pressure in a full opening testing apparatus.

The above mentioned supplementing means includes a floating piston exposed on one side to the inert gas pressure and on the second side to the annulus pressure in order that fluid pressure in the annulus can act on the gas pressure. The system is balanced to hold the valve in its normal position until the testing depth is reached. Upon reaching the testing depth, the floating piston is isolated from the annulus pressure so that subsequent changes in the annulus pressure will operate the particular valve concerned.

The prior method of isolating the floating piston has been to close the flow channel from the annulus to the floating piston with a valve which closes upon the addition of weight to the string. This is done by setting the string down on a packer which supports the string and isolates the formation during the test. The prior apparatus is designed to prevent the isolation valve from closing prematurely due to increasingly higher pressures as the test string is lowered into the wall, contains means to transmit the motion necessary to actuate the packer mentioned above, and is designed to remain open until sufficient weight is set down on the packer to prevent premature isolation of the gas pressure and thus premature operation of the tester valve being used.

The invention of copending United States application to Farley et al., Ser. No. 588,991, filed on the same date as the present application, comprises a method and apparatus for isolating the gas pressure from the fluid pressure in the annulus responsive to an increase in the annulus pressure by a predetermined amount above a reference pressure for use in an annulus pressure operated tool, wherein the operating force of the tool is supplied by the pressure of gas in an inert gas chamber in the tool. The reference pressure used is the pressure which is present in the annulus at the time a well bore sealing packer is set.

The annulus pressure is allowed to communicate with an interior bore of the apparatus as the testing string is lowered in the well bore. This pressure is trapped as the above mentioned reference pressure when the packer seals off the well bore and isolates the formation to be tested. Subsequent increases in the well annulus pressure above the reference pressure activates a pressure responsive valve to isolate the inert gas pressure from the well annulus pressure. Additional pressure increases in the well annulus causes the well testing apparatus to operate in the conventional manner.

However, the invention to Farley et al. cannot be used for treating of the oil well in conjunction with the testing. During the treating phase, various chemicals are introduced into the formation under high pressure. When the pressure in the interior bore of the tool string approaches the annulus pressure, the Farley et al. device will reopen, causing the tester to close the interior bore to the treating fluids.

The present invention comprises a method for maintaining the gas pressure isolated from the fluid pressure in the annulus after a subsequent increase in the pressure in the bore of the tool for use in an annulus pressure operated tool; wherein the operating force of the tool is supplied by the pressure of a gas in an inert gas chamber in the tool, and where the isolation is accomplished responsive to an increase in the annulus pressure by a predetermined amount above a reference pressure in the bore of the tool.

The method disclosed further includes treating a formation in an oil well in conjunction with the testing of the formation my maintaining the gas isolated from the annulus pressure during a pressure increase in the bore of the tool subsequent to the isolation of the gas, where the gas initially isolated responsive to an increase in the annulus pressure by a predetermined amount above a reference pressure in the bore of the tool.

After the isolation valve has been closed responsive to the increase of annulus pressure a predetermined amount above a reference pressure in the bore of the tool, a uni-directional acting means nullifies any subsequent increases in the interior bore pressure by balancing the forces acting on the isolation valve due to the increased interior bore pressure such that there is no movement created in the isolation valve. The uni-directional acting means is a floating piston within the isolation valve which is prevented from acting on the valve member when the annulus pressure exceeds the interior bore pressure, but which will act on the valve member in the closed direction when the interior bore pressure exceeds the annulus pressure. The force of the floating piston is opposite and equal to or greater than the force due to the increased interior bore pressure which is attempting to open the isolation valve.

The invention disclosed is simple and results in an annulus pressure operated tool which may be used for both testing and treating. The testing and treating apparatus utilizing the invention of this disclosure will not have a discontinuity in its housing such as a collapsing section used to close the previously known mechanical isolating valves; and will not open if treating fluids are introduced into the interior bore of the tool at high pressures such as occurs with previously known pressure operated isolation valves. A simplified isolating valve thus results which does not require special provision to transmit the movement necessary to set the packer, nor to support the forces of the drill string during the lowering or withdrawal of the test string in the borehole; which allows the introduction of fluid into the oil well at high pressure subsequent to the closing of the isolation valve; and which will reopen automatically when the annulus pressure is returned to its normal hydrostatic value.

THE DRAWINGS

A brief description of the appended drawings follows:

FIG. 1 provides a schematic "vertically sectioned" view of a representative offshore installation which may be employed for formation testing and treating purposes and illustrates a formation testing "string" or tool assembly in position in a submerged well bore and extending upwardly to a floating operating and testing station.

FIG. 2*a* and 2*b*, joined along section line *x—x*, provides a vertically sectioned elevational view of the preferred embodiment incorporated into a full opening testing valve assembly with the disclosed isolation valve in the open position.

FIG. 3 provides a vertically sectioned elevational view of a portion of a testing valve assembly showing the preferred embodiment of the disclosed isolation valve in the closed position where the pressure in the interior bore of the tool is less than the pressure in the well annulus.

Figure 4:
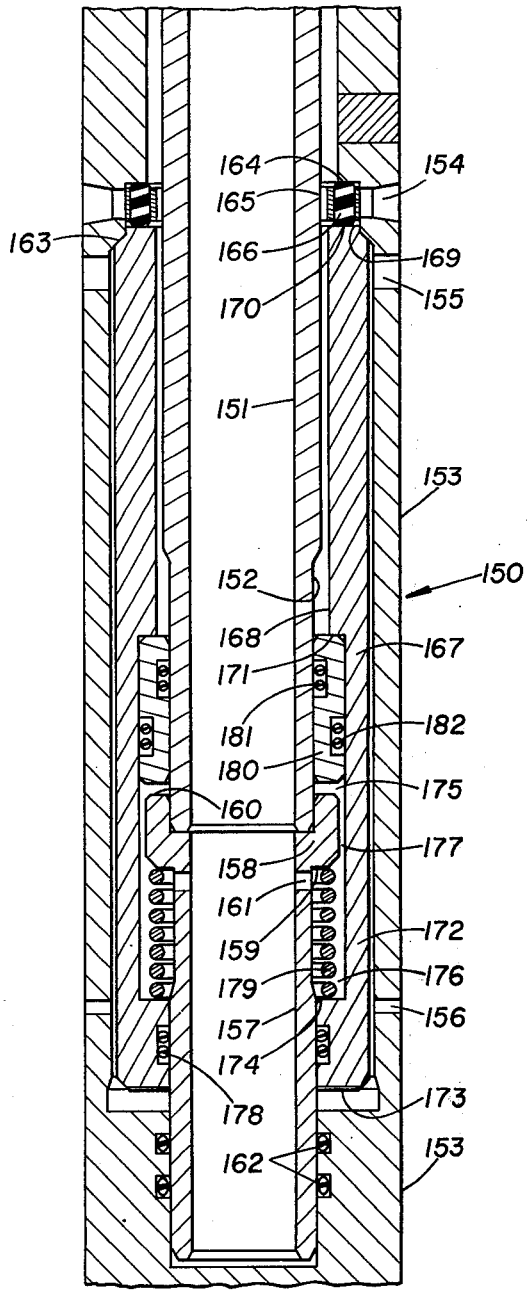

FIG. 4 provides a vertically sectioned elevational view of a portion of a testing valve assembly showing the preferred embodiment of the disclosed isolation valve in the closed position where the pressure in the interior bore of the tool is greater than the pressure in the well annulus.

OVERALL WELL TESTING AND TREATING ENVIRONMENT

During the course of drilling an oil well the borehole is filled with a fluid known as "drilling fluid" or "mud". One of the purposes, among others, of this drilling fluid is to contain in the intersected formations any fluid which may be found there. This is done by weighting the mud with various additives so that the hydrostatic pressure of the mud at the formation depth is sufficient to keep the formation fluid from escaping from the formation out into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string.

When the testing depth is reached, a packer is set to seal the borehole thus "closing-in" the formation from changes in the hydrostatic pressure of the drilling fluid.

The valve at the lower end of the testing string is then opened and the formation fluid, free from the restraining pressure of the drilling fluid, can flow into the interior of the testing string.

The testing program includes periods of formation flow and periods when the formation is "closed-in." Pressure recordings are taken throughout the program for later analysis to determine the production capabilities of the formation. If desired, a sample of the formation fluid may be caught in a suitable sample chamber.

It may be desired to conduct a treating program in conjunction with the testing program described while the test string is in place. The treating program is conducted by pumping various chemicals down the interior of the test string at a pressure sufficient to force the chemical used into the formation. The chemicals and pressure used will depend on such things as the formation material and the change in the formation properties desired to make the formation more productive.

In this manner it is possible to conduct a testing program, a treating program, and a second testing program or a treating program and a single testing program, to evaluate the effects of the treatment through the same tool string and without removal of the string between the testing and treating programs.

At the end of the testing or treating program, a circulation valve in the test string is opened, formation fluid or treating chemicals in the testing string are circulated out, the packer is released, and the testing string is withdrawn.

In an offshore location, it is desirable to the maximum extent possible, for safety and environmental protection reasons, to keep the blowout preventers closed during the major portion of these procedures. For this reason tools which can be operated by changing the pressure in the well annulus surrounding the testing string have been developed.

FIG. 1 shows a typical testing string being used in a cased, offshore well. The testing string components, and the reference numbers used are the same as those shown in aforesaid U.S. Pat. Nos. 3,664,415 tO Wray et al. and 3,856,085 to Holden et al.

By way of summary, the environment may include:

| REFERENCE NUMERALS COMMON TO PRESENT DISCLOSURE AND WRAY ET AL PATENT 3,664,415 | ITEM OF ILLUSTRATED CONTEXT |
|---|---|
| 1 | Floating drilling vessel or work station |
| 2 | Submerged well site |
| 3 | Well bore |
| 4 | Casing string lining well bore 3 and having perforations communicating with the formation |
| 5 | Formation which is to be tested and treated. |
| 6 | Interior of well bore 3 |
| 7 | Submerged well head installation including blowout preventer mechanism |
| 8 | Marine conductor extending between well head 7 to work station 1 |
| 9 | Deck structure on work station 1 |
| 10 | Formation testing string (i.e., assembly of generally tubular components extending between formation 5 and work station 1 and passing through |

-continued

| REFERENCE NUMERALS COMMON TO PRESENT DISCLOSURE AND WRAY ET AL PATENT 3,664,415 | ITEM OF ILLUSTRATED CONTEXT |
|---|---|
| | marine conductor 8 and well bore 3) |
| 11 | Hoisting means supporting testing string 10 |
| 12 | Derrick structure supporting hoisting means 11 |
| 13 | Well head closure at upper end of marine conductor 8 |
| 14 | Supply conduit for fluid operable to transmit fluids such as mud to interior 6 of well bore beneath blow-out preventers of installation 7 |
| 15 | Pump to impart pressure to fluid in conduit 14 |
| 16 | Annulus surrounding testing string 10 formed when testing string 10 is placed into well bore 3 |
| 17 | Upper conduit string portion extending to work site 1 (usually threadable interconnected conduit sections) |
| 18 | Hydraulically operated, conduit string "test tree" |
| 19 | Intermediate conduit portion |
| 20 | Torque transmitting, pressure and volume balanced slip joint |
| 21 | Intermediate conduit portion for imparting packer setting weight to lower portion of string |
| 22 | Circulating valve |
| 23 | Intermediate conduit portion |
| 24 | Upper pressure recorder and housing |
| 25 | Valving mechanism |
| 26 | Lower pressure recorder and housing |
| 27 | Packer mechanism |
| 28 | Perforated "tail pipe" providing fluid communication between interior of testing string 10 and formation 5 |

Details of components 1 through 28 and other possible components and aspects of their incorporation in the aforesaid installation as depicted in FIG. 1 are set forth in detail in columns 3 through 6 of the aforesaid Wray et al. U.S. Pat. No. 3,664,,415, the entire disclosure of which is herein incorporated by reference so as to avoid the necessity for resdescribing this representative testing environment.

In colums 3 through 5 of the aforesaid Wray et al. patent, reference is made to patents depicting details of various components of this representative context of the invention and reference is also made to U.S. patent applications depicting certain of these components. The Anderson et al. application Ser. No. 829,388 for a desirable packer as identified in column 4 of the Wray et al. patent has now issued as U.S. Pat. No. 3,584,684 June 15, 1971. Similarly, the Manes et al. application Ser. No. 882,856 referred to in columns 3, 4, 5, and 6 in relation to various components has now issued as U.S. Pat. No. 3,646,995 Mar. 7, 1972.

DESCRIPTION OF THE VALVING MECHANISM

The valving mechanism 25 shown in FIG. 1 may be similar to the oil well testing and sampling apparatus disclosed in U.S. Pat. No. 3,858,649 to Wray et al., or may be similar to the improved, full opening testing valve assembly disclosed in U.S. Pat. No. 3,856,085 to Holden et al. Portions of the preferred embodiment of FIG. 2 is similar to that disclosed in the aforesaid U.S. Pat. No. 3,856,085 to Holden et al., and the same reference numbers have been used where possible.

The overall valve assembly 100 shown in FIG. 2 includes a valve unit 101, an actuator or "power" unit 121, and a separable connecting means 139 which allows selective connection and disconnection of those two components. The isolation valve 150 of the invention is shown as a portion of the actuator unit 121.

By way of review, the valve unit 101 includes a generally tubular housing 102 having a longitudinally extending central flow passage **102*a* which is controlled by ball valve 103. When the ball valve 103 is oriented with its central passage 103*a* in the position shown in FIG. 2, the flow passage 102*a*** is blocked, and the valve is closed.

When the ball valve 103 is turned by the action of lugs **110*a* in recesses 104*a*, the ball is turned such that central passage 103*a* is aligned with flow passage 102*a* to give a fully open flow passage through the valve unit 101**.

The ball valve is held in position by valve housing 105, by upper ball valve seat 106 and by lower valve seat 107. Coil spring 108 carried by housing 102 acts to bias the valve seats 106 and 107 and the ball valve 103 together.

The lugs **110*a* are carried by actuating arms 109*a*. Actuating arms 109*a* and pull sleeve means 112 are connected together by radially inwardly extending flange portion 109*c* of the actuating arms 109*a* fitted into a groove 111 provided in the upper end of pull sleeve means 112**.

Pull sleeve means 112 is provided with lost motion means 115 to allow for some motion to occur without the ball valve 103 being activated. This is done by providing pull sleeve means 112 with an outer tubular component 113, and an inner telescoping sleeve component 114. Inner telescoping sleeve component 114 will move within outer tubular component 113 until mutually engageable means **113*a* and 114*a*** are brought together.

This lost motion means is provided to allow the momentary opening of a bypass means 116 to reduce the pressure differential across the ball valve 103 before it is opened. The bypass means 116 includes a sleeve portion **102*b* of the housing 102 having ports 118, and ports 117 provided in inner sleeve portion 114 of the pull sleeve means 112. At the end of the stroke provided by the lost motion means 115, ports 117 are aligned with ports 118 to allow pressure below the ball 103 to communicate through the ports 117 and 118 into bypass passages 119 and 120 and finally to communicate with the flow passage 102*a* of the valve unit above the ball and with the interior 10*a*** of the test string.

The actuator unit 121 is joined to the valve unit 101 by connection 139 and includes a tubular housing 122 having a flow passage **122*d* which communicates with the flow passage 102*a* of the valve unit. A tubular power mandrel 123 is telescopingly mounted in the housing 122 for longitudinal movement therein. An annular piston 124 is carried on the outer periphery of the power mandrel 123 and is received within and divides an annular chamber 125 provided in the housing 122. Shoulder portion 123*a* of the power mandrel 123 engages with surface 122*a* to limit the upward travel of power mandrel 123 in the annular cylinder 125**.

The upper side of piston 124 is exposed to the fluid pressure in the annulus 16 surrounding the tool 100 through port 126. A coil spring 127 is provided in the lower portion 125a of annular chamber 125 to oppose downward movement of the power mandrel 123.

The lower portion of the actuator housing 122 has an inner tubular mandrel 122*b*. Between the inner mandrel 122*b* and the lower housing 122*c* is an inert gas chamber 128 which is filled with compressed inert gas such as nitrogen. The inert gas chamber 128 communicates with lower chamber portion 125*a* through annular chamber extention 128*a*, and has an enlarged portion 128*c* which is divided by a floating piston 129. The upper side of floating piston 129 is exposed to the compressed nitrogen and the lower side is exposed to the fluid pressure in the annulus 16 which surrounds the tool assembly as long as the isolation valve remains open.

The operation of the above components is fully disclosed in columns 5–12 of the aforesaid U.S. Pat. No. 3,856,085 to Holden et al., the entire disclosure of which is herein incorporated by reference so as to avoid the necessity for redescribing their operation.

DESCRIPTION OF THE PREFERRED ISOLATION VALVE

The preferred isolation valve 150 of FIG. 2 controls the communication of the fluid pressure in the annulus 16 which surrounds the tool 100 with the lower side of floating piston 129. The inner wall of the isolation valve is formed by a lower inner mandrel extension 151 of the inner tubular mandrel 122*b*. Lower extension 151 has a thinner portion 152 at its lower end. The lower mandrel extension 151 has a central bore which is a continuation of the interior bore 122*d* of the tool.

The exterior wall of the isolation valve 150 is formed by a lower housing extension 153 of the actuator housing 122. The lower housing extension 153 has two sets of a plurality of spaced apart ports 154 and 155 at the upper end of the valve, and a plurality of ports 156 at the lower end of the valve. These ports provide fluid pressure communication between the well annulus 16 and the interior of the tool to provide for actuation of the valve and to provide communication with flow passage 130, as will be explained.

The lower inner wall of the isolation valve is completed by a sleeve mandrel 157 having an L-shaped cross section, and having a raised portion 158 as shown. The raised portion 158 is interleaved with the end of the lower mandel extension 151 to form a continuous inner wall for the valve. A plurality of ports 161 are provided in sleeve mandrel 157 to provide fluid pressure communication between the interior bore 122*d* of the tool and the interior of the isolation valve 150. Seals 162 are provided between L-shaped sleeve valve 157 and the housing 153. It can be seen that the joint between sleeve mandrel 157 and lower mandrel extension 151 also provides fluid communication between interior bore 122*d* and the annular chamber within the isolation valve 150. Thus, this joint does not require a seal. 60 The annular chamber 163 bounded by the actuator housing 122, the lower housing extension 153, the lower inner mandrel extension 151, and the L-shaped sleeve mandrel 157 forms a sliding valve chamber for providing fluid pressure communication between the well annulus 16 and the flow passage 130 through ports 154 and 155 in its upper end, fluid pressure communication with the well annulus 16 through ports 156 at its lower end, and fluid pressure communication with the interior bore 122d through ports 159. The upper face 164 of sliding valve chamber 163 may be sealed by a seal cushion 166 carried in a seal carrier 165 which is movable between ports 154 and 155. It can be seen that when seal cushion 166 is pushed against face 164 to form a pressure tight seal, fluid pressure communication between well annulus 16 and flow passage 130 is interrupted.

The movement of seal carrier 165 and seal cushion 166 is controlled by an L-shaped sliding valve member 167 in the sliding valve chamber 163. Sliding valve member 167 has a thickened portion 168 forming a shoulder having a downward facing surface 171. The upper end of sliding valve member 167 has an upper face 169 for pushing seal carrier 165 and seal cushion 166 into engagement with face 164, and for forming a fluid pressure tight seal with sealing cushion 166. A circular point 170 may be provided around the periphery of face 169 to form a better seal with sealing cushion 166 when sliding valve member 167 is in its upward most position.

Sliding valve member 167 extends to the lower end of sliding valve chamber 163, and is sized to allow sliding movement sufficient to control communication between the well annulus 16 and flow passage 130 by the action of sealing cushion 166 between faces 164 and 169. Seals 178 are provided between the L-shaped portion of sliding valve member 167 and L-shaped sleeve mandrel 157. Thus, the lower, external face 173 of sliding valve member 167 is exposed to the pressure present in the annulus 16 admitted through ports 156, and upward facing, interior face 174 of the sliding valve member 167 is exposed to the pressure present in the interior 122d admitted through ports 159.

The downward facing surface 171 of the sliding valve member 167, an intermediate portion of the sliding valve member 167, upward facing surface 160 of raised portion 156 of the L-shaped sleeve mandrel 157, and the thinner portion 152 of lower inner tubular extension 151 all form the bounds of an annular floating piston chamber 175 which contains floating piston 180. Seals 181 and 182 positioned in the sliding piston 180 prevent fluid pressure communication from one side of the piston to the other. Thus, floating piston 180 will move from one side of piston chamber 175 to the other, dependent on the pressure differential across piston 180.

Upward facing, interior face 174 of the sliding valve member 167, an intermediate portion of L-shaped sleeve mandrel 157, downward facing surface 159 of the raised portion 158 of mandrel 157, and an intermediate portion of the sliding valve member 167 form an annular spring chamber 176 which contains mechanical spring 179. A flow passage 177 is provided to allow fluid communication between spring chamber 176 and floating piston chamber 175.

A selectively operable disabling mechanism 138 is schematically represented in the lower wall of the actuator housing 122. This disabling mechanism is designed to provide communication between the well annulus 16 and the passage 130 in the event the pressure in the well annulus becomes excessive after the isolation valve 150 has been closed. This disabling means may comprise rupturable port means or openable valve means which is selectively operable by excessive well annulus pressure. Once disabling mechanism 138 is open, floating piston 129 may again move responsive to well annulus pressure to offset the effect of well annulus pressure acting on piston 124. When this happens, the power mandrel 123 will be forced upward by coil spring 127, and ball valve 103 will close.

The position, in FIG. 2, of disabling means 138 is more advantageous than that shown in aforesaid U.S. Pat. No. 3,856,085 because, should means 138 open, drilling fluid will not contaminate chamber 128, and inert gas will not be lost.

OPERATION OF THE INVENTION

When the testing string 10 is inserted and lowered into the well bore 3, the ball valve 103 is in the closed position. The packer allows fluid to pass around it in the annulus during the descent into the well bore. It can thus be seen that the pressure in the interior bore 122*d* of the actuation unit 121, and that portion of the bore 102*a* below the ball 103 will be the same as the pressure in the well annulus 16 as the string is being lowered.

During the lowering process, the hydrostatic pressure in the annulus 16 and the interior bore 122*d* will increase. At some point, the annulus pressure will overcome the pressure of the inert gas in chamber 128, and floating piston 129 will begin to move upward. In this manner, the initial pressure given the inert gas in chamber 128 and the lower portion of chamber 125 will be "supplemented" to automatically adjust for the increasing hydrostatic pressure in the annulus, and other changes in the environment such as increased temperature.

It can be seen that as long as the packer is not set to seal off the well bore, the hydraulic forces acting on the sliding valve member 167 will be in equilibrium. The pressure acting through ports 154, 155, and 156 will all be equal. This pressure acting on downward facing surfaces 171 and 173 will be balanced by the same pressure acting on upward facing 169 and 174. Coil spring 179 will act to hold sliding valve member 167 in the down or open position.

When the packer is set to seal off the formation 5, the pressure in the interior bore 122*d* becomes independent and will no longer be controlled by the pressure in the well annulus. The pressure thus trapped in the interior bore 122*d* then becomes the reference pressure by which the valve is controlled.

At this time, the blowout preventer mechanism in the submerged well head installation 7 may be closed. Additional pressure above the hydrostatic pressure is then added to the drilling fluid in the well annulus. Since the pressure in the interior bore 122*d* remains at the reference pressure established when the packer was set, the pressure in spring chamber 176 and the lower portion of floating piston chamber 175 will also remain at this reference pressure. The additional pressure added to the well annulus will cause the floating piston 180 to move downward until it abuts against upward facing surface 160. In this position, shown in FIG. 2, the floating piston 180 will not act on sliding valve member 167.

It can be seen that there will be an unbalance in the forces caused by the hydraulic pressures acting on sliding valve member 167 when the annulus pressure is increased above the pressure in the bore 122*d.*

When the net hydraulic force in the up direction overcomes the force of the spring 179, the sliding valve member will shift to its upmost position as shown in FIG. 3, thereby sealing face 169 with sealing cushion 166, and sealing cushion 166 with face 164 to interrupt fluid communication between well annulus 16 and flow passage 130. It will be understood that the additional pressure added to the annulus to overcome the force of the spring 179 will be communicated to the inert gas through ports 154 and 155 and flow passage 130. Thus the operating pressure of the inert gas is at a value higher than hydrostatic pressure.

Additional pressure added to the annulus above what is required to close isolation valve 150 will act on piston 124, and operate the ball valve 103, thereby allowing a testing program to be carried out in the conventional manner. As piston 124 moves under the influence of the elevated annulus pressure, coil spring 127 is compressed, and the inert gas in the lower portion of chamber 125 and in chamber 128 is further pressurized, thereby supplying the additional spring force required to return piston 124 to its original position when the annulus pressure increases are removed.

Because of the action of coil spring 127, the pressure of the inert gas in chamber 128 will not be as high as the fluid pressure in the annulus during the operation of the ball valve 103. Also, when the ball valve 103 is fully open, pull sleeve means 112 will "bottom out" against sleeve portion 102*b* of housing 102; thus, preventing further travel of piston 124.

Therefore, a further increase in annulus pressure above that required to fully open ball valve 103 will not cause a further increase in the gas pressure. The inert gas pressure is reflected by the action of floating piston 129 to the drilling fluid trapped in flow passage 130 when isolation valve 150 is closed. Gas pressure communicates through the flow passage 130, the interior bore of the seal carrier 165, and in that portion of the sliding valve chamber 163 between the sliding valve member 167 and the lower tubular mandrel extension 151, thereby acting on the upper side of piston 180.

When it is desired to treat the formation through the testing apparatus shown in FIG. 2, chemicals to be introduced into the formation are pumped through the open interior bore of the testing string at a pressure high enough to force the chemical into the formation.

The annulus pressure during a treating program may be raised above the pressure needed to fully open ball valve 103 in order to insure that the sliding valve member 167 will be tightly held in the up or closed position. The chemicals are then pumped into the interior of the test string as desired. When the pressure in the interior bore 122*d* exceeds the gas pressure, piston 180 will move up until it is abutting downward facing surface 171 of thickened portion 168 of the sliding valve member 167, as shown in FIG. 4. The hydraulic piston area of piston 180 is preferably equal to the area of upward facing surface 174 of sliding valve member 167. It can thus be seen that the force acting up on member 167 due to the higher interior bore pressure is equal and opposite to the force acting down on member 167 due to the higher interior bore pressure. Therefore, floating piston 180 acts on sliding valve member 167 in only one direction, and serves to nullify the effects of higher pressure in the interior bore of the apparatus. It can be seen that during a treating operation, isolation valve 150 will remain closed, regardless of the interior bore pressure, as long as the annulus pressure exceeds the gas pressure by a sufficient amount to keep spring 179 compressed.

Before testing string 10 is raised from the well bore, it is desirable to close ball valve 103, and to reopen the isolation valve 150 in order that the inert gas in the actuator unit 121 can return to its initial pressure. First the pressure increase, if any, added during the treating phase to the interior bore of the drill string is removed. Then the pressure increase in the annulus is removed, allowing the inert gas pressure and spring in the lower portion of chamber 125 to return piston 124 to its original position thereby closing ball valve 103.

When the annulus pressure again returns to its hydrostatic value, spring 179 will move sliding valve member 167 to its open position thereby establishing communication between the annulus 16 and the flow channel 130. The inert gas pressure will now adjust itself by the action of floating piston 129 as the testing string is withdrawn from the well, until the initial inert gas pressure is reached.

While a preferred isolation valve 150 is shown in FIG. 2 in association with a full opening well testing apparatus, the disclosed isolation valve 150 can also be used in the actuator or power section of a sampling and testing apparatus of the type disclosed in U.S. Pat. No. 3,858,649 to Wray et al. This may be done by replacing the assembly 305 and the valve represented by the ports 306 of the power section 30 disclosed in U.S. Pat. No. 3,858,649 with the isolation valve 150 of the present invention. The apparatus would then be used in a configuration invented from that shown in order that the normally closed sampling and testing valve assembly 40 would be above the improved power section 30.

The above disclosed preferred embodiment having set forth the inventive concepts involved, it is the aim of the appended claims to cover all changes or modifications which may be envisioned by one familiar with this disclosure and which do not depart from the true spirit and scope of the invention.

What is claimed is:

1. A valve for use in a tubing string located in an oil well bore and having a packer arranged for selectively sealing the well bore thereby isolating that portion of the oil well bore above the packer from that portion of the oil well bore below the packer, comprising:

valve means, incorporated in the wall of said tubing string and having a normally open position and a closed position, for controlling fluid communication between the interior of said tubing string and the oil well bore exterior of said tubing string;

pressure responsive operating means, operably connected to said valve means, for moving said valve means from the normally open position to the closed position when the pressure in that portion of the well bore above said packer is increased by a specified amount over the pressure in that portion of the well bore below the packer; and means within said operating means, for maintaining said valve means in the closed position responsive to subsequent increases in the pressure in that portion of the well bore below the packer.

2. The apparatus of claim 1 wherein said maintaining means is a uni-directional acting means for holding said valve means closed responsive to said subsequent pressure increases, and which does not act on said valve means when the pressure in tha portion of the well bore below the packer is below a preset value.

3. The apparatus of claim 2 wherein said uni-directional acting means is a floating piston responsive in one direction to the pressure in that portion of the well bore below the packer, and responsive in a second opposite direction to a pressure whose value is a predetermined amount less than the pressure in that portion of the well bore above the packer; and, wherein the travel of said floating piston is limited in the first direction by said valve means, and in the second opposite direction by the wall of said tubing string.

4. The apparatus of claim 1 further comprising:

biasing means, responsive to the operation of said pressure responsive operating means, for moving said valve means from the closed position to the normally open position when said pressure increase in that portion of the well bore above the packer is removed.

5. An apparatus, to be used in conjunction with an oil well tool operable for closing-in, testing and treating a well formation; and having a bore therethrough and a spring biasing means whose spring force is increased responsive to an increase in fluid pressure external to said tool, comprising:

valve means, in the wall of said tool, movable from an open position, wherein increases in said external fluid pressure increases the spring force of said spring biasing means, to a closed position, wherein increases in said external fluid pressure are isolated from said spring biasing means;

pressure responsive means, connected to said valve means, for moving said valve means from said open position to said closed position responsive to an increase in the pressure external to said tool a predetermined amount above the pressure in the well adjacent said closed-in formation; and means, coacting with said pressure responsive means, for maintaining said valve means in said closed position responsive to increases in the pressure in the well adjacent said formation subsequent to the closing of said valve means.

6. The apparatus of claim 5 wherein said maintaining means is a uni-directional acting means for holding said valve means closed responsive to said subsequent pressure increases, and which does not act on said valve means when the pressure in the well adjacent said closed-in formation does not exceed a pressure created by said spring biasing means.

7. The apparatus of claim 6 wherein said uni-directional acting means is a floating piston responsive in one direction to the pressure in the well adjacent said closed-in formation, and responsive in a second opposite direction to a pressure created by said spring biasing means; and wherein the travel of said floating piston is limited in the first direction by said valve means, and in the second opposite direction by the wall of said tool.

8. The apparatus of claim 5 further comprising:

biasing means, responsive to the operation of said pressure responsive operating means, for moving said valve means from the closed position to the normally open position when said pressure increase in that portion of the well bore above the packer is removed.

9. In an oil well having a tubing string in the bore of the well, said tubing string having a packer arranged for selectively sealing the well bore thereby isolating that portion of the oil well bore above the packer from that portion of the oil well bore below the packer, and a normally open valve located in the wall of said tubing string; a method of controlling fluid communication between the interior of said tubing string and the oil well bore exterior of said tubing string comprising the steps of:

sealing the bore of said oil well with said packer thereby isolating that portion of the oil well above the packer from that portion of the oil well below the packer;

increasing the pressure in that portion of the oil well bore above the packer, thereby creating a pressure differential between that portion of the well bore above the packer and that portion below the packer;

closing said normally open valve responsive to said pressure differential, thereby interrupting fluid communication between the interior of said tubing and the oil well bore exterior of said tubing;

additionally increasing the pressure in that portion of the oil well bore above the packer;

creating a second pressure responsive to said additional pressure increases whose value is a predetermined amount less than said pressure in that portion of the bore above the packer;

increasing the pressure in that portion of the oil well bore below the packer to a value higher than said second pressure; and, maintaining said valve in the closed position responsive to the pressure differential between said pressure in that portion of the well above the packer and said second pressure, and nullifying the effect on said valve of said pressure increases in that portion of the bore below the packer, thereby allowing said pressure in that portion of the bore below the packer to be increased as desired.

10. In an apparatus, to be used for closing-in, testing and treating a well formation, having a bore therethrough and a spring biasing means whose spring force is increased responsive to an increase in fluid pressure external to said tool; a method for controlling the spring force of said spring biasing means comprising the steps of:

placing said apparatus in a fluid filled well bore;

communicating fluid pressure through a normally open valve between said spring biasing means and the well bore exterior of said apparatus;

lowering the apparatus in said well bore, thereby increasing the spring force of said spring biasing means with the hydrostatic pressure of said fluid;

sealing the well bore with a packer exterior said apparatus, thereby isolating the portion of the bore above said packer from that portion below said packer;

increasing the pressure in that portion of the well bore above the packer, thereby increasing said spring force and creating a pressure differential between that portion of the well bore above said packer and that portion of the well bore below said packer;

closing said normally open valve responsive to said pressure differential, thereby interrupting fluid communication between the spring biasing means and the well bore exterior said apparatus;

additionally increasing the pressure in that portion of the well bore above the packer, thereby causing a pressure differential between a pressure created by said spring biasing means and said pressure in that portion of the well bore above said packer;

introducing fluid through the bore of said apparatus, thereby increasing the pressure in that portion of the well bore below the packer; and, maintaining said valve in the closed position responsive to the pressure differential between said pressure created by said spring biasing means and said pressure in that portion of the well bore above said packer, and nullifying the effect on said valve of said pressure increase in that portion of the well bore below the packer, thereby allowing said pressure in that portion of the well bore below the packer to be increased as desired.

11. An isolation valve for use in a fluid filled oil well bore for controlling fluid communication between the oil well bore and a flow passage in the interior of the valve, comprising:

a tubular housing having a central bore therethrough, an annular chamber in the wall of the housing, a flow passage communicating with a first end of said annular chamber, a first plurality of ports for providing fluid communication between said first end of said annular chamber and the oil well bore exterior of said valve, a second plurality of ports for providing fluid communication between a second opposite end of said annular chamber and the oil well bore exterior of said valve, and a third plurality of ports for providing fluid communication between said central bore and said annular chamber at a point intermediate said first and second pluralities of ports;

a raised shoulder portion, on the inner wall separating said annular chamber from said central bore, intermediate said third plurality of ports and the first end of said annular chamber;

sleeve valve means, located in said annular chamber and having a thickened shoulder portion intermediate said raised shoulder portion on the inner wall and the first end of said chamber, for moving toward the first end of said chamber responsive to fluid pressure in the well bore external to the valve, and for movement toward the second end of said chamber responsive to fluid pressure in said central bore;

floating piston means, between said raised shoulder portion on the inner wall of said annular chamber and said raised shoulder portion of said sleeve valve means, for movement responsive to a pressure differential between the fluid pressure in said central bore and the fluid pressure in said flow passage, wherein said floating piston means abuts against said thickened shoulder portion of said sleeve valve means where the central bore pressure is greater and abuts against said raised shoulder portion on said inner wall when the flow passage pressure is greater; and, seal means between said first end of said annular chamber and said sleeve valve means for providing a fluid pressure tight seal between said first plurality of ports and said flow passage when said sleeve valve means moves to the first end of said annular chamber.

12. The valve of claim 11 further comprising:

a second thickened shoulder portion on the end of said sleeve valve means nearest the second end of said annular chamber; and, spring means between said second thickened shoulder portion on said sleeve valve means and said raised shoulder portion for moving said sleeve valve means toward the second end of said annular chamber when the well bore pressure is equal to the central bore pressure.

* * * * *

UNITED STATES PATENT AND TRADEMARK OFFICE

CERTIFICATE OF CORRECTION

PATENT NO. : 3,964,544

DATED : June 22, 1976

INVENTOR(S) : David L. Farley and Burchus Q. Barrington

It is certified that error appears in the above-identified patent and that said Letters Patent are hereby corrected as shown below:

Column 2, line 47, "my" should read --by--

Column 7, line 61, after seal., delete the number "60"

IN THE CLAIMS

Claim 1, line 36, delete "A" and insert --In a--

Claim 1, line 40, delete "comprising" and insert --said valve having--

Claim 1, line 45, after string;, insert --and,--

Claim 1, line 52, after packer; delete "and"

Claim 1, line 53, before means, first occurrence, insert --the improvement comprising--

Claim 5, line 12, delete "An" and insert --In an--

Claim 5, line 17, delete "comprising" and insert --said apparatus having--

Claim 5, line 23, after means; insert --and,--

Claim 5, line 29, after formation; delete "and"

Claim 5, line 30, before means, first occurrence, insert --the improvement comprising--

Signed and Sealed this

Fifth Day of October 1976

[SEAL]

*Attest:*

RUTH C. MASON
*Attesting Officer*

C. MARSHALL DANN
*Commissioner of Patents and Trademarks*